United States Patent [19]

Six et al.

[11] Patent Number: 4,519,771

[45] Date of Patent: May 28, 1985

[54] FLAME DETECTION SYSTEM WITH ISOLATION BETWEEN BURNER AND ELECTRONIC CONTROL DEVICE

[75] Inventors: Jean-Claude G. Six, Versailles; Paul Claeys, Saint-Mande; Michel Guillaume, Paris, all of France

[73] Assignee: U.S. Philips Corporation, New York, N.Y.

[21] Appl. No.: 481,002

[22] Filed: Mar. 31, 1983

[30] Foreign Application Priority Data

Apr. 2, 1982 [FR] France ..... 82 05773

[51] Int. Cl.[3] ..... F23N 5/00; F23Q 23/00

[52] U.S. Cl. ..... 431/25; 431/78; 340/579

[58] Field of Search ..... 431/25, 78; 340/579, 340/577; 236/1 H, 21 R

[56] References Cited

U.S. PATENT DOCUMENTS

| | | | |
|---|---|---|---|
| 2,170,497 | 8/1939 | Gille | 236/1 H |
| 2,313,943 | 3/1943 | Jones | 431/25 |
| 2,379,873 | 7/1945 | Lange | 236/1 H |
| 3,614,280 | 10/1971 | Yamaguchi | 431/78 X |
| 3,902,839 | 9/1975 | Matthews | 431/25 X |
| 4,113,419 | 9/1978 | Cade | 431/78 |
| 4,177,033 | 12/1979 | Wallace | 431/78 |
| 4,238,184 | 12/1980 | Schilling | 431/78 X |
| 4,459,097 | 7/1984 | Riordan et al. | 431/25 |

*Primary Examiner*—Samuel Scott
*Assistant Examiner*—Kenichi Okuno
*Attorney, Agent, or Firm*—Robert T. Mayer; Bernard Franzblau

[57] ABSTRACT

A method for detecting the operation of a burner uses the rectifying effect of the burner flame, when an alternating voltage is applied between the burner (1) and an electrode (2). A control device (18) is connected to the primary of an isolating transformer (6) which receives a high frequency alternating voltage from a generator (7). The current rectified by the flame provides dumping of the circuit at the secondary of the transformer which is used to detect the presence of a flame. An igniter (25) may be connected to the same electrode of the burner via an element (28) whose resistance varies with the voltage.

17 Claims, 2 Drawing Figures

Figure 1:
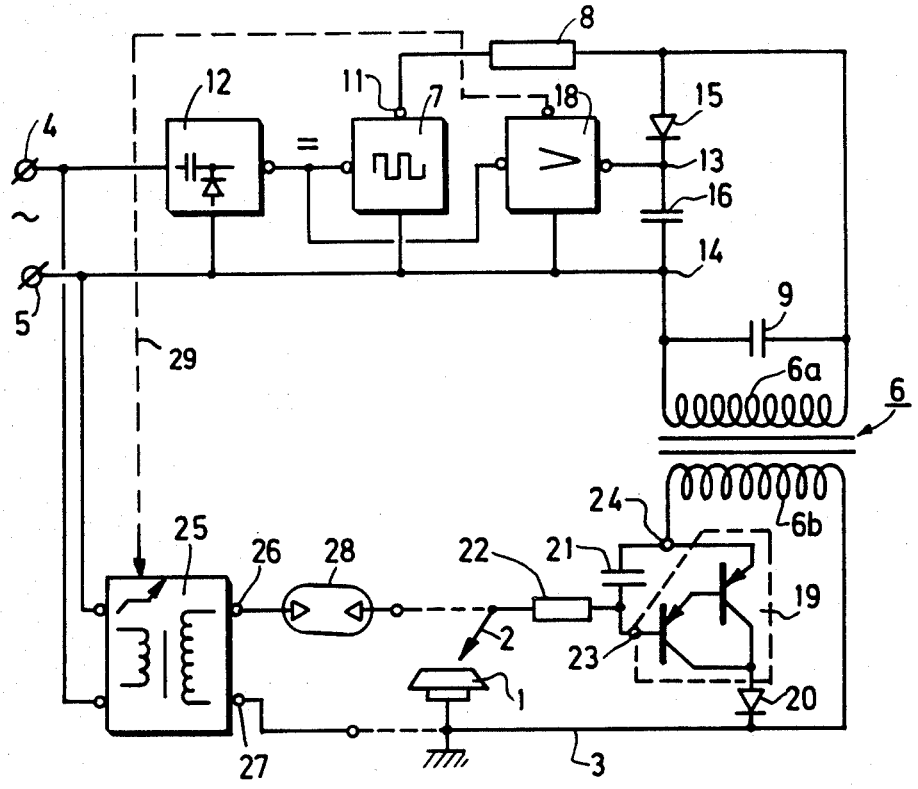

FLAME DETECTION SYSTEM WITH ISOLATION BETWEEN BURNER AND ELECTRONIC CONTROL DEVICE

This invention relates to a method of detecting a burner flame, in particular of a gas burner, using the rectifying effect of the flame when a signal from an a.c. generator is applied between an electrode which is in contact with the flame and the burner which functions as the counter-electrode, the part of the circuit which comprises the a.c. generator being isolated from the part of the circuit which comprises the burner and the electrode by means of an isolating transformer.

The invention also relates to a flame-detection device utilising the said method.

A method of detecting a burner-flame which employs the rectifying effect of the flame is known from U.S. Pat. No. 4,177,033. This document describes the use of the rectifying effect of a flame in a detector for a rectified and smoothed direct voltage when an alternating voltage from the 50-Hz AC supply is applied to the burner/electrode gap. Said Patent also states that the alternating voltage may be applied to the burner/electrode gap from the secondary of an isolating transformer whose primary is connected to the supply mains. Indeed, it should be possible to connect the burner to the appliance chassis which in its turn is connected to ground for obvious reasons of safety, in particular when the burner is situated in the proximity of the user, as in the case of gas burners used for cooking.

Another technical solution, also proposed in the aforementioned document, is to connect the flame-detection circuit directly to the AC supply voltage. However, in order to provide protection at the location of the burner/electrode gap by means of a resistor in series with the power supply, this resistor should have a very high value (for example 27 MΩ). This solution, though very simple, has drawbacks, in particular because protection by means of a resistor of high value is not allowed by all safety regulations. Also at the start of operation, a distinction must be made between the conductors of the AC supply source (the so-called "neutral" conductor and the "phase" conductor) and the very high impedance with which the flame-detection circuit is energized results in a poor performance of the system in the event that the electrode is soiled and the burner/electrode gap is shunted by a spurious resistance.

It is also preferred to utilize an isolating transformer for the a.c. supply of the part of the circuit comprising the burner and the electrode although this solution is slightly more intricate and in practice requires the use of an isolating transformer of comparatively high power for also energizing the safety circuits and devices associated with the flame-detection device.

The invention proposes an improvement to this method in order to reduce its costs and to reduce the electric power of the isolating transformer.

It is another object of the invention to facilitate the isolation of the part of the circuit comprising the burner and the electrode from the AC supply source.

In accordance with the invention a method of detecting a burner flame, in particular of a gas burner, using the rectifying effect of the flame when a signal from an a.c. generator is applied between an electrode which is in contact with the flame and the burner which acts as the counter-electrode, the part of the circuit which comprises the a.c. generator being isolated from the part of the circuit which comprises the burner and the electrode by means of an isolating transformer, is characterized in that the information about the presence or absence of a flame is received in the form of a variation of a rectified and smoothed voltage, which is taken from the terminals of the primary of the isolating transformer. The rectifying effect of the flame then is used for damping the secondary circuit of the transformer, and the a.c. generator is coupled to the primary via an impedance which is adapted to the damping of the primary of said transformer.

In accordance with the inventive method the flame detector is connected to the part of the circuit comprising the a.c. generator, i.e. to the circuit on the primary side of the isolating transformer. This has the advantage of a simple coupling to the control or safety elements, which in turn are energized from the AC supply source. Moreover, this enables a reduction of the number of elements in the part of the circuit which comprises the burner/electrode gap and which is isolated from the AC supply source.

A preferred form of the method in accordance with the invention utilizes an a.c. generator whose frequency is substantially higher than the 50-Hz power frequency. In this respect a substantially higher frequency is to be understood to mean a range which extends for example between 10 kHz and 1 MHz, although these extreme values do not constitute absolute limits for the present method. Because of this high frequency the isolating transformer can be substantially smaller and hence cheaper.

The method in accordance with the invention also makes it possible to use a substantially lower impedance than the known devices. Thus, only if the burner-electrode gap is soiled very heavily, which is less likely to occur, will the information about the presence of the flame no longer be correct because the operation is impaired by the spurious resistance in parallel with the burner/electrode gap.

In an advantageous form of the method in accordance with the invention the secondary circuit of the isolating transformer is damped substantially during one of the two halfwaves of the applied alternating voltage, which permits the use of very simple circuitry.

The invention also relates to a flame-detection device for carrying out the method described above. This device is characterized in that the main current path of an active semiconductor device is connected in series with a diode poled in the forward direction of the main current path. In series with the burner/electrode gap, a capacitor and a resistor are connected to the secondary terminals of the isolating transformer. The capacitor has one electrode connected to a secondary terminal of the transformer and the other electrode to the resistor, which is also connected to a control terminal of the semiconductor device. This device employs very simple means for damping the secondary circuit of the isolating transformer and enables the ionic conduction of the flame to be distinguished from undesired conduction as a result of contamination of the burner/electrode gap.

As the active semiconductor device it is advantageous to use a Darlington amplifier, the control terminal being connected to the base of the input transistor of said amplifier. This type of amplifier is more sensitive than a simple high-gain bipolar transistor so that the device in accordance with the invention will function correctly even under very difficult conditions, e.g. a small flame or a heavily soiled or oxidized electrode.

The device in accordance with the invention may also be used in the case that where the secondary of an ignition transformer is coupled to the same electrode (the electrode which is used for flame detection) so that this electrode produces a spark for igniting the burner. In the device in accordance with the invention the secondary of said ignition transformer is then coupled to the burner/electrode gap via an element whose resistance varies with the voltage, for example a spark gap, the arrangement being connected to the burner/electrode gap in parallel with the secondary circuit of the isolating transformer.

Figure 2:
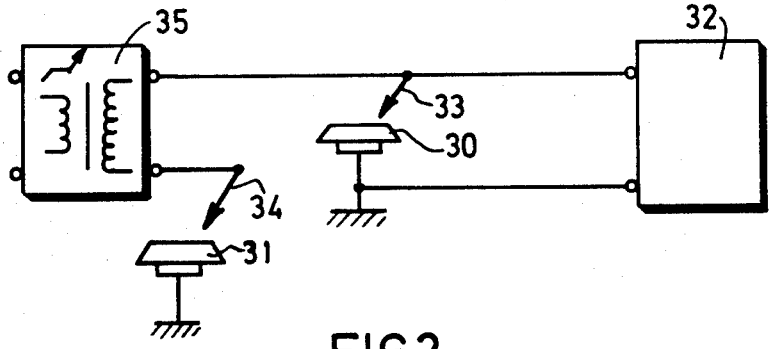

The invention will now be described in more detail, by way of example, with reference to the accompanying drawings in which:

FIG. 1 is a circuit diagram, part block diagram, of a flame-detection device using the method in accordance with the invention, and FIG. 2 is a block diagram of a device for detecting a burner flame, the ignition being common to this burner and another burner.

The method in accordance with the invention will be described with reference to FIG. 1. In a manner known per se, a burner 1, for example a gas burner, is provided with an electrode 2 which is in contact with the flame and which effects flame detection through the rectifying effect of the flame in conjunction with an alternating electric signal applied between the burner 1 and the electrode 2. From an electrical point of view the burner functions as the counter-electrode, but from the mechanical point of view it is connected to the gas supply pipe and to other basic elements of the appliance. Moreover, it is desirable that the conductor 3 be electrically grounded, as indicated in the Figure. As the device is energized from the terminals 4 and 5 of the AC supply source, whose frequency may be 50 Hz and whose voltage may be 220 V, the two parts of the circuit are isolated by means of an isolating transformer 6.

In the present case an a.c. generator 7 is used whose frequency is substantially higher than 50 Hz, that is between 10 kHz and 1 MHz. In the present example this frequency is approximately 200 kHz. The generator 7 may be a simple multivibrator of very low power. It energizes the primary *6a* of the isolating transformer 6 via a matching resistor 8 which provides a relative decoupling between the generator 7 and the transformer 6. The primary winding *6a* of the transformer 6 is tuned to the operating frequency by means of the capacitor 9 which is arranged in parallel with said winding. The combined effect of the matching resistor 8 and the tuning capacitor 9 results in a substantially sinusoidal signal across the primary of the transformer 6, even though the signal from the generator 7 appearing at its output terminal 11 is a squarewave signal.

The generator 7 is supplied with direct current by means of a power-supply circuit 12 which is connected to the terminals 4 and 5 of the AC supply source. The circuit 12 may be of a very simple design in view of the very low power consumption. In the present example, it is of a known type with a capacitive impedance which provides the desired reduction of the high supply voltage to the low voltage required for the various electronic functions. As the method in accordance with the invention employs the rectifying effect of the flame for damping the secondary circuit *6b* of the isolating transformer 6, this damping also influences the primary transformer circuit *6a*, where the variations of the rectified and smoothed voltage are utilized for deriving the information about the presence or absence of the flame.

The relevant voltage is available between points 13 and 14 after rectification by the diode 15 and smoothing by the capacitor 16. This voltage is applied to the input of a control circuit 18 comprising, in this order, a voltage comparator, all the circuitry required for signalling, the alarm, the safety measures to be taken, for example turning off an igniter, as will be described hereinafter and, after a time delay, shutting off the gas supply by an electric valve. The indication about the presence or absence of the flame is received by the part of the circuit comprising the primary of the isolating transformer 6 and the a.c. generator 7, which part of the circuit is connected directly to one terminal of the AC supply mains (the terminal 5 in FIG. 1). Thus, all the operating functions can be energized simply and directly from the AC supply mains. However, the operation of the part of the circuit comprising the secondary *6b* of the isolating transformer 6, the burner 1 and the electrode 2, which part is isolated from the AC supply source and of which the conductor 3 is connected to ground, is greatly simplified, i.e. the load connected to the terminals of the secondary *6b* of the isolating transformer 6 is made to vary. Moreover, the isolating transformer 6 can be made substantially smaller because use is made of an alternating signal of a high frequency in comparison with 50 Hz. For the frequency of 200 kHz in the present example a transformer having a ferrite magnetic circuit with a total volume not greater than 10 $cm^3$ was found to perform satisfactorily. The insulation of the two windings *6a* and *6b* from each other is simpler because of the smaller number of turns as compared with an isolating transformer operating at 50 Hz. In the present example, the primary *6a* comprises 20 turns and the secondary *6b* comprises 80 turns. It is evident that such a transformer is of a cheap construction.

The diagram of FIG. 1 indicates how the rectifying object of the flame can be used simply for damping the secondary circuit *6b* of the isolating transformer 6. The ionic conduction of the flame itself acts to damp the secondary circuit of the transformer 6 via the direct connection of the burner/electrode gap to the terminals of the secondary winding *6b*, as distinct from what is shown in FIG. 1. However, it is preferred to employ current amplification by means of an active semiconductor device in order to obtain operation at a substantially lower impedance with the consequent advantages.

In a preferred embodiment of the invention, in which the secondary of the isolating transformer is damped substantially during one halfwave of the applied alternating voltage, the main current path of an active semiconductor device 19, indicated by broken lines in the Figure, which device is arranged in series with a diode 20 poled in the forward direction of this main current path, and a capacitor 21 and a resistor 22, in series with the burner 1/electrode 2 gap, are connected to the terminals of the secondary *6b*. One electrode of the capacitor 21 is connected to a terminal of the secondary winding *6b* of the isolating transformer 6 and the other electrode, which is connected to the resistor 22, is also connected to the control terminal 23 of the semiconductor device 19. A suitable active semiconductor device 19 is a bipolar transistor having a high gain at a low current level. FIG. 1 shows a suitable embodiment which employs a Darlington amplifier comprising the combination of two PNP transistors. The control electrode 23 of the device 19 is the base of the input transistor of the amplifier and the main current path is the path between the emitter of the output transistor and the commoned collectors of the two transistors.

The circuit described with reference to FIG. 1 operates as follows: The a.c. generator 7 supplies a square-wave voltage with a total amplitude in the order of 12 V.

In the absence of a flame the secondary circuit of the isolating transformer 6 is not loaded. The sinewave voltage at the terminals of the primary 6*a* is then approximately 5 V and that across the secondary 6*b* is in the order of 20 V (r.m.s. values) in the case of a winding ratio of approximately 4. If the burner 1/electrode 2 gap is not soiled most of the voltage supplied by the secondary of the transformer 6 appears across this gap. If the burner/electrode gap is soiled a spurious resistance is formed which shunts this gap. However, regardless of the value of this spurious resistance, the resistor 22 arranged in series with it imposes a lower limit on the overall resistance, namely 100kΩ in the present example. This value is sufficiently high to ensure that the damping thus exerted on the secondary 6*b* of the transformer 6 remains negligible. The Darlington amplifier 19 does not conduct because the capacitor 12, whose value has been selected so that its impedance is low in comparison with the value of the resistor 22, keeps the input terminal 23 substantially at the same potential as the emitter of the output transistor (terminal 24). Moreover, the diode 20 inhibits conduction of the amplifier 19 during the halfwave whose polarity is the inverse of that of the main current path of this amplifier. In the absence of a flame the secondary 6*b* of the transformer 6 is therefore hardly loaded. The rectified voltage appearing between points 13 and 14 has its upper nominal value of approximately 2 V, which is interpreted as the absence of the flame by the control circuit 18.

Now it is assumed that there is a flame at the burner 1. The ionizing action of the gases in the flame produce a slight conduction of the gap between the burner 1 and the electrode 2, which conduction is greater in the direction from the electrode towards the burner than in the opposite direction. As a result of this rectifying effect the capacitor 21 is charged and the potential on the control terminal 23 is reduced relative to that on the terminal 24, until the amplifier 19 is turned on. However, this conduction in the main current path takes place only during each halfwave of the signal in which the diode 20 operates in the forward direction. The secondary 6*b* of the transformer 6 is therefore loaded during this halfwave in such a way that the alternating voltage on its terminals decreases. However, this decrease influences the charge on the capacitor 21 so that in reality an equilibrium is produced in which one of every two halfwaves of the alternating voltage applied to the transformer 6 is damped and appears as though it has been rectified. The rectifying voltage obtained between points 13 and 14 is lower than in the nominal situation, which is its "low state" of the order of a volt, which is interpreted as the presence of a flame by control circuit 18.

Soiling of the gap between the burner 1 and the electrode 2 can influence the device only so as to increase the safety. Indeed, if the spurious resistance which shunts the burner/electrode gap remains high the device will operate correctly. This is because the conduction of the Darlington amplifier 19 is caused by the rectifying effect of the burner/electrode gap only. When the soiling is such that the value of the spurious resistance becomes lower than that of the resistor 22, for example smaller than 50K, the capacitor 21 is no longer charged sufficiently and the amplifier 19 is no longer conductive so that the control circuit 18 interprets the high state of the voltage then received at its terminals as the absence of a flame. The safety measures taken are then the same as though the flame has extinguished accidentally. The same happens if the electrode 2 is covered with an oxide layer which inhibits the rectifying action of a flame. The Darlington amplifier 19 will then no longer conduct. This means that there are difficult situations in which the detection device indicates the absence of a flame although a flame is present, but the opposite situation does not occur.

An example of a flame-detection device, in which the secondary of an ignition transformer is also coupled to the electrode 2 for producing a spark for the ignition of the burner, will now be described with reference to FIG. 1. The arrangement comprising the igniting device, known per se, is shown block-schematically and is designated 25, which arrangement is energized from the terminals 4 and 5 which are connected to the AC supply source and at the output side comprises an ignition transformer whose secondary winding is connected to the terminals 26 and 27. These terminals are coupled to the gap between the burner 1 and the electrode 2 via an element 28 whose resistance varies with the voltage and whose resistance value is quasi-infinite at low voltage. The element 28 may for example be a spark trap or voltage threshold device. Thus, the igniter 25 is connected, in accordance with the broken lines, to the burner/electrode gap in parallel with the detection circuit described in the foregoing, but in the absence of ignition pulses it is electrically isolated from this circuit by the variable resistance element 28. During the very short time in which the ignition spark is produced the Darlington amplifier 19 is protected against high-voltage pulses by the resistor 22.

Obviously, it is advantageous to control the igniter 25 automatically by the control circuit 18, which is symbolically represented by the connection 29 shown in broken lines in FIG. 1.

Experience shows that the use of the same electrode 2 both for detection and for ignition has several advantages. Firstly, the construction of the applicance is simplified. Moreover, if a substantial oxidisation of the electrode reduces the rectifying effect so that a high signal is applied to the control circuit 18 although in fact a flame is present, the igniter is activated and the spark which is then produced eliminates a sufficient part of the oxide covering the electrode to restore its normal rectifying action.

The device shown in FIG. 1 is particularly suitable for a sequential operation of the burner 1. In this case the control circuit 18 comprises the necessary electronic function and also controls the closure and opening of an electric valve, not shown, arranged in the gas supply to the burner 1.

FIG. 2 shows a cooling appliance comprising two burners 30 and 31, only the burner 30 being connected to a detection device 32 as described in the foregoing and both burners 30 and 31 being coupled to a common igniter 35. The two output terminals of said igniter 35 are each connected to an electrode, 33 and 34 respectively. The gap between the burner 31 and the electrode 34 now functions as the spark trap 28 in FIG. 1 for the detection device 32. It is to be noted that the secondary winding of the ignition transformer has a very high impedance for the 200 kHz a.c. signal and that the gap between the burner 31 and the electrode 34 also has a very high impedance for direct current (both when a flame is present and absent), in particular if the electrode 34 is not in contact with the flame, which is not necessary here.

It is obvious that several variants to the examples described are conceivable within the scope of the present invention. For a cooking top comprising two burners, as shown in FIG. 2, the case has been described in which only one burner is connected to the detection device in accordance with the invention. If desired, the second burner may also be connected to a second detection device identical to the first one, but as an alternative only the part of the detection circuit relating to the secondary winding *6b* of the isolating transformer 6 (which winding itself is duplicated) may be duplicated while the part of the circuit comprising the primary *6a* assists in the detection for both burners. Then only the control circuit 18 has to be modified slightly in such a way that the reference threshold for the comparison of the rectified signal available between points 13 and 14 is adapted depending on whether two burners are used simultaneously or only one burner at a time. In each case the increase of the voltage value relative to the reference threshold will be interpreted as the absence of at least one flame and the safety devices may be actuated. When two secondary windings are used on the isolating transformer it is possible to use the damping of the circuit during one halfwave for one of the burners and during the other halfwave for the other burner. Moreover, by means of a resistor in series with the main current path of the amplifier 19 it is possible to limit the damping ratio of the signal for each burner and to use only one secondary winding coupled to a plurality of burners. The control circuit 18, which is common to a plurality of burners, will receive a rectified voltage whose value depends on the number of burners which must be in operation at this instant. The control circuit can then monitor a plurality of burners by triggering the ignition circuit or circuits of all the burners simultaneously if the absence of a flame is detected. Other safety devices may be actuated if the undesired condition persists after a predetermined delay.

What is claimed is:

1. A method of detecting a burner flame using the rectifying effect of the flame which comprises: applying a signal from an a.c. generator between an electrode in contact with the flame and the burner which functions as a counter-electrode, electrically isolating a first part of the circuit which comprises the a.c. generator and a voltage detector from a second part of the circuit which includes the burner and the electrode by means of an isolating transformer, whose primary winding is coupled directly to the voltage detector and via a resistor to the a.c. generator and whose secondary winding is coupled to a secondary circuit, the presence of a flame producing a rectified current in the secondary circuit which provides damping of said secondary circuit, which damping is transferred to the primary of the transformer, and measuring the presence or absence of a flame by means of a variation of a rectified and smoothed voltage developed at the input of the voltage detector.

2. A method as claimed in claim 1, characterized in that the frequency of the a.c. generator lies between 10 kHz and 1 MHz.

3. A method as claimed in claim 1 characterized in that the signal applied from the a.c. generator comprises an alternating voltage made up of two halfwaves and the secondary circuit of the transformer is damped substantially during one of the two halfwaves of the applied alternating voltage.

4. A flame detection device for detecting the flame in a gas burner comprising: a pair of input terminals for connection to a low frequency source of AC voltage, a high frequency AC generator energized from said input terminals, an isolation transformer having a primary winding coupled to the output of the AC generator via a resistor and a secondary winding for applying a high frequency signal between an electrode of the burner in contact with a flame and the burner which functions as a counter-electrode, a detection circuit having an input coupled to the transformer primary winding via a rectifier and a smoothing capacitor, first means connecting the main current path of an active semiconductor device in series with a diode poled in the forward direction of the main current path across the transformer secondary winding, second means connecting a capacitor, a second resistor and the burner electrode and counter-electrode in series across the transformer secondary winding such that the capacitor has one electrode connected to a terminal of the transformer secondary winding and a second electrode connected to the resistor and to a control electrode of the semiconductor device, the rectifying effect of a burner flame on the high frequency signal producing a damping effect on said transformer so that the presence or absence of a flame is reflected via the transformer to the input of the detection circuit as a variation of a rectified and smoothed voltage.

5. A flame detection device as claimed in claim 4 wherein the burner counter-electrode is connected to ground and the transformer secondary winding is damped during alternate half-cycles of the applied high frequency signal.

6. A flame detection device as claimed in claim 4 wherein the impedance of the capacitor at said high frequency is low compared to the resistance of the second resistor.

7. A flame detection device as claimed in claim 4 wherein the high frequency generator is energized from said input terminals via an AC/DC converter, and wherein one of said input terminals is directly connected to one terminal of the transformer primary winding, to one terminal of the AC generator and to one terminal of the detection circuit.

8. A flame detection device as claimed in claim 4 further comprising an ignition transformer having a primary winding coupled to said input terminals and a secondary winding, a voltage threshold device, and means connecting said voltage threshold device in series with the burner electrode and counter-electrode across the ignition transformer secondary winding.

9. A flame detection device as claimed in claim 4 further comprising an ignition transformer having a primary winding coupled to said input terminals and a secondary winding, a second gas burner having an electrode in contact with the flame and wherein the burner thereof functions as a counter-electrode, means coupling one terminal of the ignition transformer secondary winding to the electrode of the first burner and a second terminal of the ignition transformer secondary winding to the electrode of the second burner, and means connecting the counter-electrodes of the first and second burners to ground whereby the gap of one gas burner functions as a voltage threshold device for the other gas burner.

10. A flame detection device as claimed in claim 4 further comprising an igniter including an ignition transformer having a primary winding coupled to said input terminals and a secondary winding, a voltage threshold device coupled between one terminal of the ignition transformer secondary winding and said burner electrode to supply thereto a spark to ignite the burner, means coupling a second terminal of the ignition transformer secondary winding to the burner counter-electrode, and wherein the igniter is automatically controlled by said detection circuit.

11. A flame detection device as claimed in claim 4 wherein the AC generator comprises a multivibrator, a second capacitor connected in parallel with the isolation transformer primary winding to form a resonant circuit tuned to the operating frequency of the multivibrator so as to produce a sinusoidal signal across said primary winding, and wherein said rectifier is connected between one input terminal of the detection circuit and one terminal of the transformer primary winding, the smoothing capacitor being connected between said one input terminal and a second terminal of the transformer primary winding, and means connecting said second terminal of the transformer primary winding to a second input terminal of the detection circuit and to one of said input terminals.

12. A flame detection device as claimed in claim 4 further comprising means directly connecting one terminal of the transformer primary winding to one of said input terminals, and means connecting the burner counter-electrode directly to ground.

13. A flame detection device for a gas burner comprising, means for applying a signal from an AC generator between an electrode which is in contact with the flame and the burner, the burner functioning as a counter-electrode, a transformer for isolating the part of the circuit which includes the AC generator from the part of the circuit which includes the burner and the electrode, said transformer having a primary coupled to the AC generator via a resistor, the presence of a flame producing a rectified current in a secondary circuit of the transformer, means connecting the main current path of an active semiconductor device in series with a diode to the transformer secondary, said diode being poled in the forward direction of the main current path of the semiconductor device, means connecting a gap between the burner and the electrode in series with a capacitor and a resistor to the terminals of the secondary of the isolating transformer, the capacitor having one electrode connected to a terminal of the transformer secondary and the other electrode to the resistor, and means connecting the resistor to a control terminal of the semiconductor device, and wherein said rectified current in the secondary circuit provides a damping influence on the primary of the transformer, the presence or absence of the flame appearing at the terminals of said primary in the form of a variation of a rectified and smoothed voltage.

14. A device as claimed in claim 9, wherein the active semiconductor device comprises a Darlington amplifier, the control terminal being connected to the base of an input transistor of said amplifier.

15. A device as claimed in claim 14 further comprising, means coupling the secondary of an ignition transformer to the gap between the burner and the electrode via an element whose resistance varies with voltage so that said electrode produces a spark for igniting the burner, means connecting the arrangement of said element and said ignition transformer secondary to said gap in parallel with the secondary circuit of the isolating transformer.

16. A device as claimed in claim 13 wherein the secondary of an ignition transformer is coupled to the gap between the burner and the electrode via an element whose resistance varies with voltage whereby said electrode produces a spark to ignite the burner, the arrangement of the ignition transformer secondary and said element being connected to the gap between the burner and the electrode in parallel with the secondary circuit of the isolating transformer.

17. A device as claimed in claim 16 further comprising a second gas burner including an electrode in contact with the flame and with the burner thereof functioning as a counter-electrode, means coupling the secondary of said ignition transformer to the electrode of the second burner, characterized in that a gap between the burner counter-electrode and the electrode of said second burner serves as the element whose resistance varies with the voltage.

* * * * *

UNITED STATES PATENT AND TRADEMARK OFFICE

CERTIFICATE OF CORRECTION

PATENT NO. : 4,519,771

DATED : May 28, 1985

INVENTOR(S) : JEAN-CLAUDE G. SIX ET AL

It is certified that error appears in the above-identified patent and that said Letters Patent is hereby corrected as shown below:

In the Abstract:

Line 2, after "flame" delete "," (comma)

Line 7, change "dumping" to --damping--

In the Claims:

Claim 14, line 1, change "9" to --13--

Claim 15, line 6, after "burner," add --and--

Signed and Sealed this

*Twelfth* Day of *August 1986*

[SEAL]

*Attest:*

DONALD J. QUIGG

*Attesting Officer*

*Commissioner of Patents and Trademarks*